US007185833B2

(12) United States Patent
Geskin et al.

(10) Patent No.: US 7,185,833 B2
(45) Date of Patent: Mar. 6, 2007

(54) METHOD FOR FLUID JET FORMATION AND APPARATUS FOR THE SAME

(76) Inventors: Ernest Geskin, 21 Karren Pl., Edison, NJ (US) 08817; Boris Goldenberg, 240 E. 79th St., New York, NY (US) 10021; Thomas Ursic, 125 Woodhill Rd., Newton, PA (US) 18940

( * ) Notice: Subject to any disclaimer, the term of this patent is extended or adjusted under 35 U.S.C. 154(b) by 71 days.

(21) Appl. No.: 10/803,781

(22) Filed: Mar. 18, 2004

(65) Prior Publication Data

US 2005/0205695 A1 Sep. 22, 2005

(51) Int. Cl.
*B05B 1/00* (2006.01)
*B05B 1/30* (2006.01)

(52) U.S. Cl. ..... 239/600; 239/596; 239/597; 239/546; 239/602; 239/533.1; 239/533.13; 239/533.14; 239/598; 239/599

(58) Field of Classification Search ..... 239/596, 239/597, 600, 601, 599, 598, 107, 436, 437, 239/533.1, 533.13, 533.14, 546, 602, DIG. 12
See application file for complete search history.

(56) References Cited

U.S. PATENT DOCUMENTS

| | | | | |
|---|---|---|---|---|
| 1,133,771 A | | 3/1915 | Wernicke | |
| 1,889,201 A | | 11/1932 | Holveck | |
| 2,985,304 A | | 5/1961 | Chryst et al. | |
| 3,447,756 A | * | 6/1969 | Lawrence, Jr. | 239/594 |
| 4,258,885 A | * | 3/1981 | Legeza | 239/707 |
| 4,492,339 A | * | 1/1985 | Kreitzberg | 239/230 |
| 4,800,688 A | * | 1/1989 | Suzuki | 451/102 |
| 4,988,042 A | * | 1/1991 | Del Prato et al. | 239/263 |
| 5,170,946 A | | 12/1992 | Rankin | |
| 5,307,996 A | * | 5/1994 | Kataoka et al. | 239/424 |
| 5,862,993 A | | 1/1999 | Bagung | |
| 2003/0192955 A1 | * | 10/2003 | Geskin et al. | 239/1 |
| 2004/0155125 A1 | * | 8/2004 | Kramer et al. | 239/601 |

FOREIGN PATENT DOCUMENTS

| | | |
|---|---|---|
| DE | 24 08 808 | 9/1975 |
| FR | 1373520 | 9/1964 |
| FR | 2772646 | 6/1999 |
| WO | WO 00/47330 A | 8/2000 |

* cited by examiner

*Primary Examiner*—Kevin Shaver
*Assistant Examiner*—James S. Hogan
(74) *Attorney, Agent, or Firm*—Ostrolenk, Faber, Gerb & Soffen, LLP

(57) ABSTRACT

A nozzle having a housing and an assembly including at least two conjugated parts separated by a spacer seal. The assembly is arranged in the housing so as to form a nozzle outlet. At least one of he housing, the parts, and the spacer seal are deformable so as to define a geometry of the nozzle outlet and seal surfaces between the parts and the spacer seal and between the parts and the housing.

9 Claims, 5 Drawing Sheets

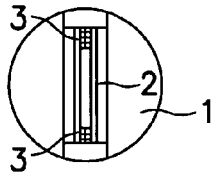
Figure 16A
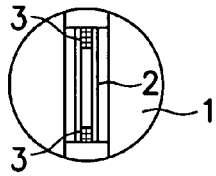
Figure 17A
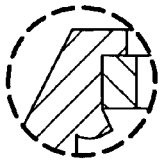
Figure 16C
Figure 17C
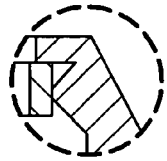
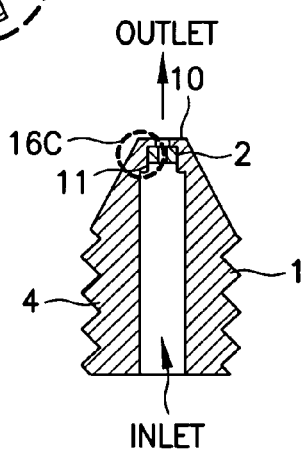
Figure 16B
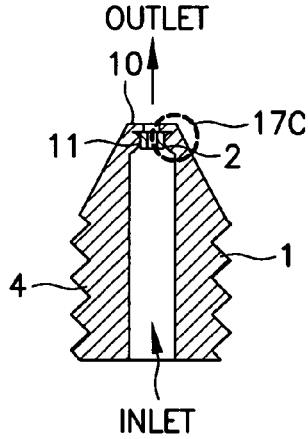
Figure 17B
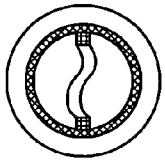
Figure 18A
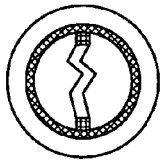
Figure 18B
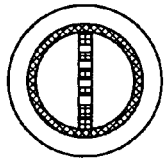
Figure 18C
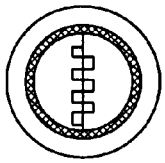
Figure 18D
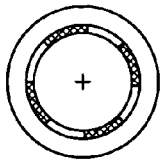
Figure 18E
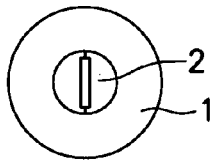
Figure 19

METHOD FOR FLUID JET FORMATION AND APPARATUS FOR THE SAME

BACKGROUND OF THE INVENTION

The present invention relates to a method for forming a fluid jet, and a nozzle for producing the jet. A fluid jet is normally produced by accelerating the fluid.

The most common method of fluid acceleration is the variation of the fluid stream cross section. The most common apparatus for implementing this method is a nozzle. A traditional nozzle design is a solid part with a channel where the fluid acceleration occurs. The advantage of this apparatus is complete sealing of the channel and simplicity of formation of a conical and cylindrical channel. In a number of applications (see for example, E. S. Geskin, B. Goldenberg Book: "Particals on Surface 8: Detection, Adhesion and Removal" Editor: K. L. Mittal, VSP Utrecht, Boston, 2003, pp. 141–151, and E. S. Geskin, B. Goldenberg, 2003 WJTA American Waterjet Conference, Aug. 17–19, 2003, Houston, Tex.) the circular cross section of the jet is not optimal. In such applications as, for example, cutting, cleaning or decoating, a rectangular jet with a high aspect ratio is much more effective than a round one.

The efficiency of the jet processing is enhanced when a round jet is converted into a plane one. The most common way of such a conversion is the use of the fan nozzle. This mode of conversion, however, involves a significant loss of the jet's kinetic energy, which in turn, is a reduction in jet efficiency. An attempt to increase the efficiency of the fan nozzle is made by U.S. Pat. No. 1,133,771. In this patent, the fan nozzle is formed by a set of elements so that the exit head loss is minimal. However, this nozzle cannot withstand a high pressure because it is composed of several elements with no reliable sealing between the elements. This changes the jet geometry and thus its weakening.

The modification of the round jet geometry is suggested by U.S. Pat. No. 2,985,384, which suggests the use of a square nozzle, or U.S. Pat. No. 5,170,946 where non-round, e.g., the rhombic, geometries are suggested. According to these patents a desired jet geometry is achieved by using a set of adjacent elements. The jet sealing in this nozzle is due to the hydraulic resistance of the contact edges achieved by the close attachment of perfectly polished elements. However, the ultra precision polishing is a complicated and expensive procedure. Moreover, the perfect attachment of two elements per se does not assure perfect sealing, especially at high fluid pressure.

The most efficient material processing by the impacting fluid is achieved by the use of a rectangular jet with a desired aspect ratio. In this case an optimal energy flux is uniformly delivered to the workpiece surface. U.S. Pat. No. 5,862,993 suggests the formation of a nozzle in which the length of the base is variable during jet formation by movement in steps. However, this design does not provide a sealing of contact surfaces, and thus cannot be used at high pressure. An attempt to attain the sealing of the elements forming the nozzle is suggested by U.S. Pat. No. 3,447,756, where the jet is formed by two closely attached elements with channels in the conical case. However, it is difficult to create the micron sized channels. Moreover, this design again does not assure sealing at high fluid pressure.

The patent application "Method for Jet Formation and Apparatus for the Same" Publication No. US2003/0192955 provides a generic technique for jet formation which involves the use of elastic and plastic deformation of parts which form the nozzle channel. Particularly, this invention provides means for formation of the rectangular jet with a very large aspect ratio, suitable, for example, for forming micro-and nano jets.

SUMMARY OF THE INVENTION

Accordingly, it is an object of the present invention to provide a method and nozzle for forming a jet in which nozzle sealing is improved, the control of the jet cross-sectional geometry is improved, and the cost of jet fabrication is reduced, relative to the prior art.

Pursuant to the present invention, the sealing of the nozzle and the nozzle geometry are improved by forming the jet with an assembly of several parts so that a degree of elastic and plastic deformation of each part assures a desired hydraulic resistance of the parts boundary as well as desired opening geometry. The desired deformation of the parts is attained in the course of the nozzle assembly as well as by application of additional forces to the nozzle parts after assembly.

One embodiment of the inventive method for jet formation and the nozzle for its implementation involves inserting two deformable main parts into a housing and separating the parts with a deformable spacer seal. The shape of the spacer seal determines the geometry of the jet while deformation of the spacer seal and parts determines the jet sealing. In order to precisely control the deformation of the spacer seal, it is fabricated of a multilayer composite material containing a hard layer to maintain its integrity, a plastic layer to control shape and an elastic layer to generate tensile stresses which assure the seal integrity. The spacer seal thickness that determines the thickness of the jet can vary from several nanometers to several millimeters. The deformable parts are separated from the housing by an elastic part having a shape, for example, an ellipse, such that the part has variable deformation. Thus, variable stresses are exerted on the parts forming the channel.

In order to precisely control the sealing between the main parts and the inserted part and between the main parts and the housing, the exterior shape of the main parts and the interior of the housing have a conical shape. The angles of the generating lines of the interior of the housing for the exterior of the parts are selected so that the deformation of the parts assures generation of the elastic stresses needed for sealing the nozzle. As the result of the sealing of all adjacent surfaces in the nozzles, the fluid pressure is secured in the range of 0–200 ksi.

In order to minimize the hydraulic losses in the nozzle, the shape of the slot has the optimal curvature at the entrance and the exit as well as the optimal shape of the slot. The surface roughness of the jet forming opening is minimal. In order to attain desired nozzle geometry the parts forming the nozzle are assembled and then forced into the housing. The surface of the opening is processed so that its roughness and waviness are minimal.

For a more complete understanding of the jet formation and a nozzle apparatus for producing a jet of the present invention, reference is made to the following detailed description and accompanying drawings in which the presently preferred embodiments of the invention are illustrated by way of example. That the invention may be embodied in several forms without departing from the spirit or essential characteristics thereof, it is expressly understood that the drawings are for purposes of illustration and description only, and are not intended as a definition of the limits of the invention. Throughout the following description and drawings, identical reference numbers refer to the same component throughout the several views.

BRIEF DESCRIPTION OF THE DRAWING(S)

Figure 13C:
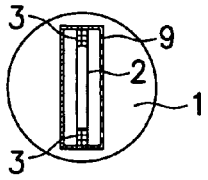
Figure 14C:
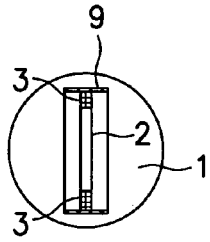
Figure 15C:
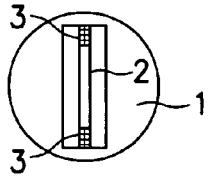
Figure 13B:
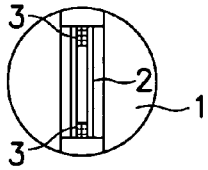
Figure 14B:
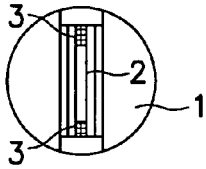
Figure 15B:
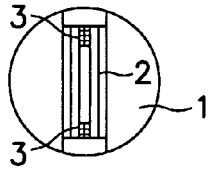
Figure 13A:
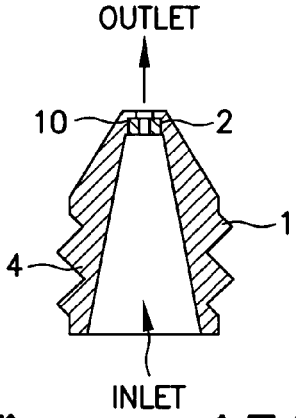
Figure 14A:
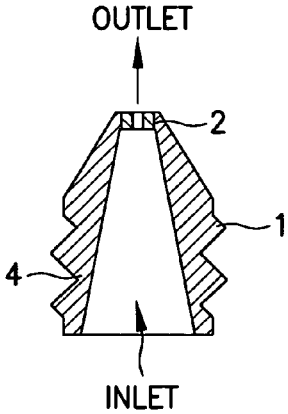
Figure 15A:
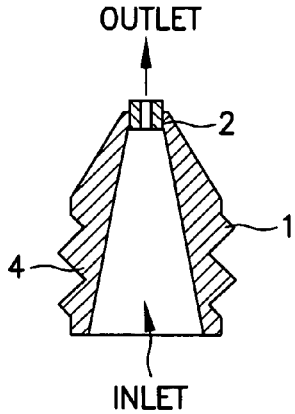

FIGS. 13*a–c* show an inlet side view, an outlet side view, and a sectional view of a nozzle with a first embodiment of a seal;

FIGS. 14*a–c* are views similar to FIGS. 13*a–c* of a further embodiment of a seal;

FIGS. 15*a–c* show yet another embodiment of a seal;

FIGS. 16*a–c* show an outlet view and section through a nozzle showing the sealing space between the parts and the parts supported by a bead;

FIGS. 17*a–c* are views as in FIGS. 16*a–c* of another embodiment;

FIGS. 18*a–e* show various slot nozzles; and

FIG. 19 shows another embodiment.

DETAILED DESCRIPTION OF THE INVENTION

Figure 1:
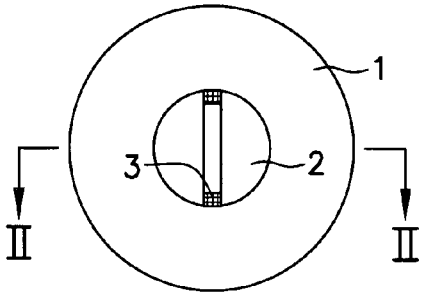
FIG. 1 is a top view of a first embodiment of the nozzle pursuant to the present invention.
Figure 2:
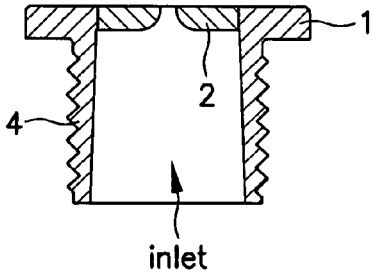
FIG. 2 is a section along the line of 2—2 of FIG. 1.

FIGS. 1 and 2 show a force-fit nozzle comprising a housing 1, two force-fit parts 2 having a cross section, e.g. segment, equal to the cross section of the housing interior and separated by a rectangular spacer seal 3. The parts 2 are force-fit inserted into the housing 1. The fluid enters the nozzle via an inlet. The housing has a fitting 4 that connects the nozzle with a pipeline. The parts can be of any suitable material, such as steel, ceramic, carbon fiber, diamond, etc.

The spacer seal material can be a brazable material that is later heated after being placed between the parts 2 so as to melt and subsequently solidify to form a seal. The material can be melted by induction heating, or by another other suitable heating source.

The nozzle generates a plane stream with an aspect ratio changing from 1 to 100,000 and generates slot jets having a thickness from several nanometers to several millimeters. The shape of the slot jet is determined by the thickness (for example, between 1 micron and 5 mm) of the insert. The sealing of the space between the segments and the spacer seal and the segments and the housing is attained by the plastic and elastic deformations of the segments, spacer seal and housing. In order to secure the sealing the housing hardness is less than that of the parts. The nozzle is formed by pressing the segments-spacer seal assembly into the housing. The force applied to the assembly constitutes 0–200% of the force needed for deformation of the spacer seal. The geometries of the surfaces formed by the exterior of the parts and the spacer seal. The geometries of the surfaces formed by the exterior of the parts and interior of the housing are almost similar. Small angles of inclination of these surfaces to the nozzle axis have a small difference which determines the elastic and plastic deformation of the nozzle assembly and the housing. This deformation generates forces almost normal to the nozzle axis, which assures sealing of the nozzle. For example, the cross sections of the parts are segments, the interior of the housing may be conical with a generating line having an inclination slightly higher than the generating line of the exterior of the parts. Alternatively, other inclinations may be used including where the inclination is lower than the generating line of the exterior of the parts.

During the course of forcing the assembly into the housing the developed elastic forces and the plastic flow of materials assure sealing of all contact surfaces. The spacer seal under these conditions works as a sealing agent to assure closing of the space between the surfaces of two parts. At the same time the spacer seal determines the distance between the parts that is the width of the slot and that of the generated jet.

Figure 3:
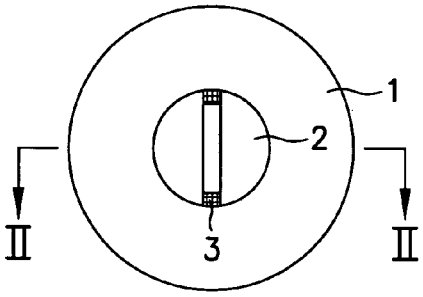
FIG. 3 is a view as in FIG. 1 of a second embodiment.
Figure 4:
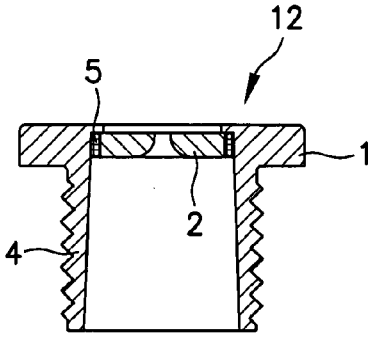
FIG. 4 is a section along the lines IV—IV of FIG. 3.

The nozzle shown in FIGS. 3 and 4 contains an additional sealing part. The parts or segments 2 and the housing 1 are separated by a conical deformable ring 5, supported by a horizontal shoulder 12. In this case, the exterior of the parts 2 as well as the interior of the ring 5 can be formed with no inclination, but need not be. The deformation is due to the inclination of the interior of the housing 1 and the exterior of the ring 5. In this case ring deformation assures sealing between the housing 1 and the assembly as well as between the assembly parts. In order to precisely control the shape of the nozzle opening, the cross section of the ring is variable and the ring has the form of an ellipse so that the force exerted by the ring on the segment is minimal at the large ellipse diameter and maximal at the minimal diameter.

In order to improve sealing of the space between the sealing and the housing shown on FIGS. 1–8, the housing inside has a conical side surface and almost the same angle as the parts 2 (FIG. 1) or the sealing ring 5 (FIGS. 3–6). The angles of the generating lines of both surfaces are different and may range, for example, without limitation, from 0 (a cylinder) to about 20 degrees.

In some applications it is necessary to use several parallel streams following in sequence (FIGS. 5 and 6) or focusing two or more streams. For example, in the course of depainting of a car body it is necessary to remove several layers of paint and then to clean the surface. Each layer requires specific impact conditions to be successfully removed. Thus, a sequence of parallel jets is needed to optimize process conditions. The separation of the flow into two streams (FIGS. 3–8) occurs by the use of three parts separated by two spacer seals. A deformable seal can be used to seal the space between the assembly containing three parts 2 and two spacer seals 3 from the housing or N parts and N-1 inserts.

Figure 5:
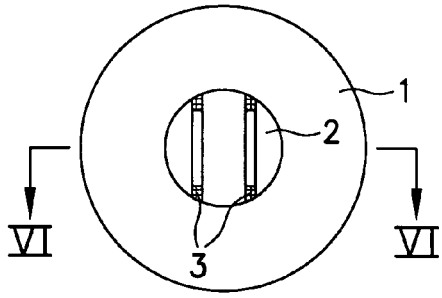
FIG. 5 is a view as in FIG. 1 of another embodiment.
Figure 6:
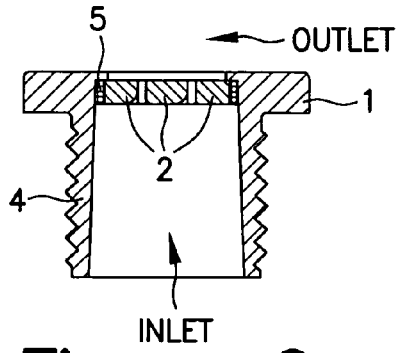
FIG. 6 is a section along the line VI—VI of FIG. 5.

FIGS. 5 and 6 show a nozzle comprising two or more parts 2 having, e.g., a segment cross section, separated by the spacer seal 3 between each of the parts. The parts are force fit inserted into the housing 1 and connected via the fitting 4 with a pipeline which supplies the fluid into the inlet. The parts 2 are separated from the housing by the deformable seal 5 and generate n-1 parallel jets, where n is a number of parts 2.

Figure 9:
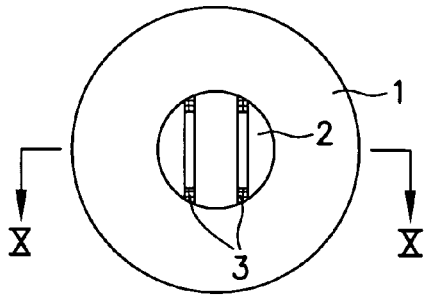
FIG. 9 is a view as in FIG. 1 of a fifth embodiment.
Figure 10:
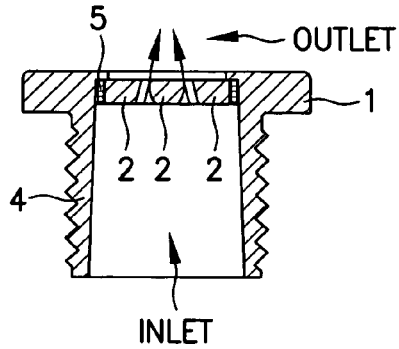
FIG. 10 is a view along line X—X of FIG. 9.

FIGS. 9 and 10 show a nozzle comprising more than two parts 2 having, e.g., a segment cross section where the joint sides of two adjacent parts 2 incline to the nozzle axis at a selected angle and are separated by a spacer seal 3 between the parts. The parts are force fit inserted into the housing 1 and connected via the fitting 4 with a pipeline which supplies the fluid into the inlet. The parts are separated from the housing by the deformable seal 5 and generate n-1 jets having a desired direction of focusing.

Figure 7:
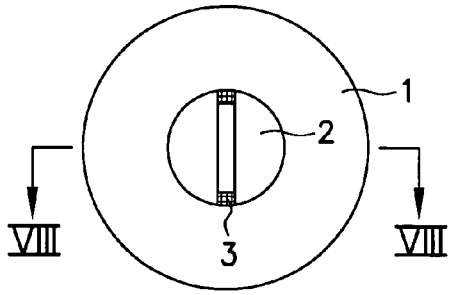
FIG. 7 is a view as in FIG. 1 of a fourth embodiment of the invention.
Figure 8:
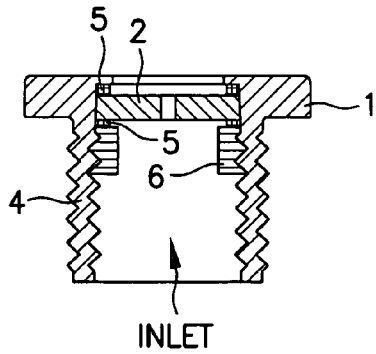
FIG. 8 is a view along the line VIII—VIII of FIG. 7.

The space between the parts 2 and the housing 1 can be supported by two rings at the top and the bottom. The upper ring and the assembly itself is pressed by a socket having an opening for the passage of the compressed fluid. FIGS. 7 and 8 show a nozzle comprising two parts 2 having, e.g., a segment cross section separated by a spacer seal 3 between each of the parts. The parts are force fit inserted into the housing 1 and connected via the fitting 4 with a pipeline which supplies the fluid into the inlet. The parts are separated from the housing by two deformable seals 5 located at the bottom and the top of the parts and compressed by socket screw 6 with a hole for fluid.

Figure 11:
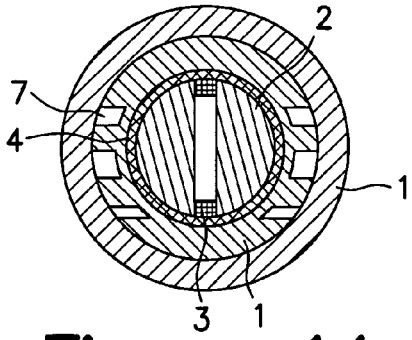
FIG. 11 is a section along the line XI—XI of FIG. 12.
Figure 12:
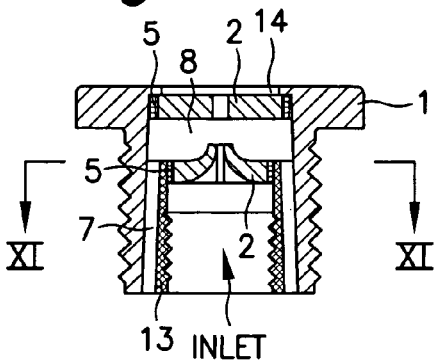
FIG. 12 is a sectional view similar to FIG. 2 of a sixth embodiment of the invention.

Formation of a mixing chamber 8 containing two sequential nozzles is shown in FIGS. 11–12. The inner nozzle 13 is inserted into the outer nozzle 14. The inner nozzle 13 operates as a regular nozzle and supplies a fluid stream into the inlet section of the outer nozzle 14. An additional stream into the outer nozzle 14 is supplied via channels 7 between the outer surface of the inner nozzle 13 and the inner surface of the outer nozzle 14. Both streams are mixed in the chamber 8 and form a stream containing uniformly distributed components supplied into the nozzles 13 and 14. The slots of the nozzles have coincidental center lines, but the inner nozzle 13 has a smaller aperture (opening) and has channels 7 along the outside surface which fit into the outer nozzle 14 and are used to supply a second fluid or particle, such as an abrasive. The inner nozzle 13 has an inside thread for connecting to a pipeline with high pressure liquid. The outer nozzle 14 has an outside thread for connecting to a pipeline with fluid or particles which are mixed in the chamber 8 between the two nozzles. This forms a fluid mixture jet.

The streams to be mixed can also have the opposite direction and impacting jets enter the mixing chamber 8. In this case, the streams exit the nozzles 13 and 14 and collide in the mixing chamber 8. The developed mixture exits via an outlet of the nozzle 14.

FIGS. 13–15 show various ways of sealing of the nozzles comprising the parts 2 separated by spacer seal 3 forming the exit cross section. The interior of the housing 1 has a geometry similar to that of the assembly exterior. For example, if the cross sections of the parts 2 are segments, the interior of the cross section of the housing is a circumference. In addition to the elastic forces, the positioning of the assembly can be controlled by a bead 10 that restricts the assembly motion along the nozzle in the direction of flow. FIGS. 13*a*–*c* show the case where there is a space between the housing and the assembly. FIG. 13*a* is a view from the inlet side of the nozzle. FIG. 13*b* is a view from the outlet side, and FIG. 13*c* is a longitudinal section through the nozzle. The space between the parts and the housing is filled by a sealing substance such as a glue, special alloy, etc., that can be expanded by heating or by cooling. The space can be filled by a shape memory alloy in order to permit on-line control of jet geometry. In this case, the nozzle is facilitated by a special temperature control system, for example, an induction coil. The shape memory alloys can also be used for fabrication of the insertions, parts, bids, etc. This will enable controlling the jet properties on-line.

FIGS. 14*a*–*c* show the case where sealing is attained by the fabrication of the parts 2 and the spacer seals 3 with different angles of inclination in order to generate needed elastic forces for a force fit. FIGS. 15*a*–*c* show a nozzle where sealing is attained by the deformation of the parts and the housing. The exterior of the nozzle assembly and the conical interior of the housing have similar or substantially similar surfaces that are deformed so that the developed elastic forces are sufficient for nozzle sealing. In this case special materials are to be used for fabrication of the parts and spacer seal and housing so that deformation thereof generates the desired stresses within the nozzles. For example, the housing can be fabricated out of an elastic material so that the deformation creates the desired elastic forces.

FIGS. 16 and 17 show a nozzle fabricated out of low precision parts. Here the assembly containing the parts 2 and spacer seal 3 (spacer seals) is restricted by two deformed beads 10 and 11. The deformation of the beads in FIGS. 16*a* and 16*b* occurs during the nozzle assembly, as shown in the enlarged view of FIG. 16*c*, while the bead in FIGS. 17*a* and *b* is assembly inserted into the housing, as shown in FIG. 17*c*. The deformation of the bead 11 assures sealing of all the elements of the nozzle.

FIGS. 18*a*–*e* show various forms of the jet. While the geometry as well as materials of the housing and parts can change in a wide range, the most efficient shapes of the assembly include cross sections that are rectangular, circular or ellipsoidal and a circular or non-circular ring. In the case of the ring opening, the nozzle contains two independent housings, connected by links. The advantage of the rectangular shape is the feasibility to control the jet width off-line by changing the spacer seal or on line by the use of the shape memory alloys for fabrication of the parts of the spacer seal. The ring shape jet allows liquid impact based stamping operations. As shown in FIG. 18*a*, the nozzle outlet has a curved shape. FIG. 18*c* shows a discontinuous outlet, while FIG. 18*d* shows each of the parts 2 having a toothed construction so that the outlet is formed by open portions on alternate opposite sides of a center line. Furthermore, FIG. 18*e* shows an outlet that is a discontinuous circular or ring annulus.

In FIG. 19, there is shown an embodiment in which the parts 2 each have a highly polished surface region that is diffusion bonded to an adjacent polished surface of the other part 2. The slot between the parts 2 can be formed by a channel provided in at least one of the parts 2. In this way, when the parts 2 are fusion bonded together the slot is created. Diffusion bonding is known to those skilled in the art and essentially is a bonding of two parts which results from highly polishing surfaces of both the parts so that the parts bond together due only to the polishing of the parts and the placement of the polished surfaces against one another. Thus, the nozzle is essentially produced by providing two parts which together will form a nozzle, forming a recess in at least one of the parts so that when the parts are placed together a slot will be formed, polishing the surfaces of the parts which will come in contact with one another to a degree so that diffusion bonding will occur when the parts are placed together, and finally placing the parts together into a housing so that diffusion bonding occurs between the contacting highly polished surfaces of the parts.

A benefit of the diffusion bonding is that the resulting slot is surrounded by the same material on all sides, rather than an inherently softer separating seal as in the previously discussed embodiments. Due to the same material being on each side of the slots, there is a reduced risk of degradation of the slot size taking place during use of the slot.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A nozzle, comprising:

a housing; and an assembly including at least two deformable conjugated parts separated by a spacer seal, the assembly being arranged in the housing so as to form a nozzle outlet, the housing and the parts and the spacer seal being deformable so as to define a geometry of the nozzle outlet and seal surfaces between the parts and the spacer seal and between the parts and the housing;

wherein the parts and the spacer seal are configured so that an assembly force needed for inserting the assembly into the housing exceeds a force that deforms the housing and the assembly, and wherein the parts and the housing are deformed by the assembly force when assembled together to create a seal between the housing and the assembly and between the parts and the spacer seal and to provide a desired nozzle outlet geometry.

2. A nozzle according to claim 1, wherein the housing is cylindrical, the parts are circle segments, and the spacer seal is rectangular.

3. A nozzle according to claim 2, and further comprising a deformable ring arranged between an inner shoulder of the housing and the assembly so as to seal the outlet of the nozzle.

4. A nozzle according to claim 2, wherein a plurality of conjugated parts and spacer seals are arranged in a sequence so as to form parallel openings.

5. A nozzle according to claim 4, wherein the assembly is configured to form several streams that focus at a common point.

6. A nozzle according to claim 1, wherein the housing has a rectangular internal cross-sectional shape.

7. A nozzle according to claim 1, wherein the nozzle outlet has a zig-zag shape.

8. A nozzle according to claim 1, wherein the nozzle outlet is discontinuous.

9. A nozzle according to claim 1, wherein the nozzle outlet is formed by openings on alternate opposite sides of a center line.

* * * * *